US009181937B2

(12) United States Patent
Ota et al.

(10) Patent No.: US 9,181,937 B2
(45) Date of Patent: Nov. 10, 2015

(54) DISPLACEMENT CONTROL VALVE

(71) Applicants: KABUSHIKI KAISHA TOYOTA JIDOSHOKKI, Aichi-ken (JP); EAGLE INDUSTRY CO., LTD., Tokyo (JP)

(72) Inventors: Masaki Ota, Kariya (JP); Noriyuki Shintoku, Kariya (JP); Ryo Matsubara, Kariya (JP); Naoki Nishimura, Tokyo (JP); Hideki Higashidozono, Tokyo (JP); Keigo Shirafuji, Tokyo (JP); Toshinori Kanzaki, Tokyo (JP)

(73) Assignees: KABUSHIKI KAISHA TOYOTA JIDOSHOKKI, Aichi-ken (JP); EAGLE INDUSTRY CO., LTD, Tokyo (JP)

( * ) Notice: Subject to any disclaimer, the term of this patent is extended or adjusted under 35 U.S.C. 154(b) by 287 days.

(21) Appl. No.: 13/672,757

(22) Filed: Nov. 9, 2012

(65) Prior Publication Data

US 2013/0126017 A1 May 23, 2013

(30) Foreign Application Priority Data

Nov. 17, 2011 (JP) ..... 2011-251820

(51) Int. Cl.
*F04B 27/18* (2006.01)

(52) U.S. Cl.
CPC ..... *F04B 27/1804* (2013.01); *F04B 2027/1813* (2013.01); *F04B 2027/1827* (2013.01); *F04B 2027/1831* (2013.01); *F04B 2027/1845* (2013.01); *Y10T 137/7761* (2015.04)

(58) Field of Classification Search
CPC ..... F04B 27/1804; F04B 2027/1831; F04B 2027/1827; F04B 2027/1813; F04B 2027/1845
USPC ..... 417/270, 271, 222.2, 222.1; 91/504, 91/505, 506, 473, 482, 483
See application file for complete search history.

(56) References Cited

U.S. PATENT DOCUMENTS 5,842,835 A 12/1998 Kawaguchi et al.
6,010,312 A 1/2000 Suitou et al.

(Continued)

FOREIGN PATENT DOCUMENTS

EP 0814263 12/1997
EP 0928898 7/1999

(Continued)

OTHER PUBLICATIONS

Search report from E.P.O., mail date is Mar. 5, 2013.

*Primary Examiner* — Bryan Lettman
(74) *Attorney, Agent, or Firm* — Greenblum & Bernstein, P.L.C.

(57) ABSTRACT

A displacement control valve includes an electromagnetic solenoid, a drive force transmitting body actuated, and a pressure sensitive portion having a pressure sensitive body that selectively extends and contracts in the movement direction of the drive force transmitting body in correspondence with pressure in a pressure sensitive chamber. A first valve body is arranged in the pressure sensitive body to adjust the cross-sectional area of an outlet passage. A second valve body is connected to the drive force transmitting body to adjust the cross-sectional area of a supply passage. The pressure sensitive body is movable in the movement direction of the drive force transmitting body in the pressure sensitive chamber. The pressure sensitive chamber is configured to communicate with the control pressure chamber. The pressure sensitive body is urged by the pressure in the control pressure chamber in the direction in which the first valve body closes.

8 Claims, 5 Drawing Sheets

(56) References Cited

U.S. PATENT DOCUMENTS

| | | | | |
|---|---|---|---|---|
| 6,164,925 | A | 12/2000 | Yokomachi et al. | |
| 6,354,811 | B1 * | 3/2002 | Ota et al. | 417/222.2 |
| 2007/0116578 | A1 * | 5/2007 | Fukanuma et al. | 417/222.2 |
| 2009/0246041 | A1 * | 10/2009 | Taguchi | 417/307 |

FOREIGN PATENT DOCUMENTS

| | | |
|---|---|---|
| EP | 0945617 | 9/1999 |
| EP | 1099852 | 5/2001 |
| JP | 11-280660 | 10/1999 |

* cited by examiner

DISPLACEMENT CONTROL VALVE

BACKGROUND OF THE INVENTION

The present invention relates to a displacement control valve configured to be used in a variable displacement compressor. In the variable displacement compressor, refrigerant is supplied from a discharge pressure zone to a control pressure chamber through a supply passage and sent out from the control pressure chamber to a suction pressure zone through an outlet passage. In this manner, the pressure in the control pressure chamber is adjusted to control displacement of the compressor.

Such variable displacement compressors include a control pressure chamber accommodating a swash plate having a variable inclination angle. Specifically, the inclination angle of the swash plate decreases as the pressure in the control pressure chamber increases. The inclination angle increases as the pressure in the control pressure chamber decreases. A decrease in the inclination of the swash plate leads to a decreases in the piston stroke, thus decreasing displacement of the compressor. In contrast, an increase in the inclination angle of the swash plate causes an increase in the piston stroke so that the compressor displacement increases.

The pressure in the control pressure chamber is adjusted using, for example, a displacement control valve disclosed in Japanese Laid-Open Patent Publication No. 11-280660. The displacement control valve includes a first valve mechanism for adjusting the opening degree of a passage extending from a crank chamber to a suction chamber in correspondence with extension/contraction of a bellows sensing the pressure in the suction chamber or the crank chamber. The displacement control valve also has a second valve mechanism for adjusting the opening degree of a passage extending from a discharge chamber to the crank chamber in correspondence with opening/closing of the first valve mechanism. The second valve mechanism receives the pressure in the crank chamber or the suction chamber on the surface of a second valve body opposite to the surface of the second valve body by which the second valve body contacts a valve seat. In the second valve mechanism, the pressure receiving area of each of the opposite surfaces of the second valve body is adjusted to substantially cancel the influence by the pressure in the discharge chamber in the directions in which the second valve body is selectively opened and closed. An urging spring is arranged between a valve casing receiving the bellows and the bellows. The urging spring urges the bellows in the direction in which the first valve mechanism closes.

To prevent the second valve mechanism from being influenced by the discharge pressure, the displacement control valve applies the pressure in the crank chamber or the suction chamber also to the back pressure portion of the second valve body. Also, the displacement control valve adjusts the discharge pressure through the valve body so that the displacement control valve as a whole does not receive the discharge pressure. Further, the bellows is urged by the spring to maintain the first valve body in a closed state even when the pressure in the suction chamber increases and the bellows contracts. In addition, since the second valve body is maintained in an open state, a minimum displacement is maintained constantly even when the electric current value in the electromagnetic solenoid is zero.

The bellows is urged by the urging spring such that the first valve body is urged toward a valve hole closing position. The urging force of the urging spring is set to such a value that the first valve body is maintained in the closed state even if the pressure in the suction chamber increases and the bellows contracts. Accordingly, when the first valve body is urged to open by the electromagnetic solenoid, an electric current must be supplied to the electromagnetic solenoid by an amount corresponding to the urging force of the urging spring. Also, when the pressure in the crank chamber increases at the minimum displacement at which the first valve body is maintained in the closed state, a guide is urged by the pressure in the crank chamber to open the first valve body. If the urging force of the urging spring is small compared to the pressure in the crank chamber, the first valve body opens.

As has been described, the conventional configuration allows the first valve body to open when the pressure in the crank chamber increases at the minimum displacement, at which the first valve body is maintained in the closed state. As a result, the minimum displacement cannot be maintained, and the power consumption of the compressor cannot be reduced.

SUMMARY OF THE INVENTION

Accordingly, it is an objective of the present invention to provide a displacement control valve used in a variable displacement compressor that reliably maintains a desirable minimum displacement operation.

To achieve the foregoing objective and in accordance with one aspect of the present invention, a displacement control valve is provided that is configured to be used in a variable displacement compressor. Refrigerant is supplied from a discharge pressure zone to a control pressure chamber through a supply passage and sent out from the control pressure chamber into a suction pressure zone through an outlet passage to adjust the pressure in the control pressure chamber so that displacement is controlled. The displacement control valve includes an electromagnetic solenoid, a drive force transmitting body actuated by the electromagnetic solenoid, a pressure sensitive portion, a first valve body, and a second valve body. The pressure sensitive portion has a pressure sensitive chamber configured to communicate with the control pressure chamber and a pressure sensitive body that selectively extends and contracts in a movement direction of the drive force transmitting body in correspondence with pressure in the pressure sensitive chamber. The first valve body is arranged in the pressure sensitive body to adjust the cross-sectional area of the outlet passage. The second valve body is connected to the drive force transmitting body to adjust the cross-sectional area of the supply passage. The pressure sensitive body is movable in the movement direction of the drive force transmitting body in the pressure sensitive chamber. The pressure sensitive body is urged by the pressure in the control pressure chamber in a direction in which the first valve body closes.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A clutchless variable displacement compressor employing a displacement control valve according to a first embodiment of the present invention will now be described with reference to FIGS. 1 to 6.

Figure 1:
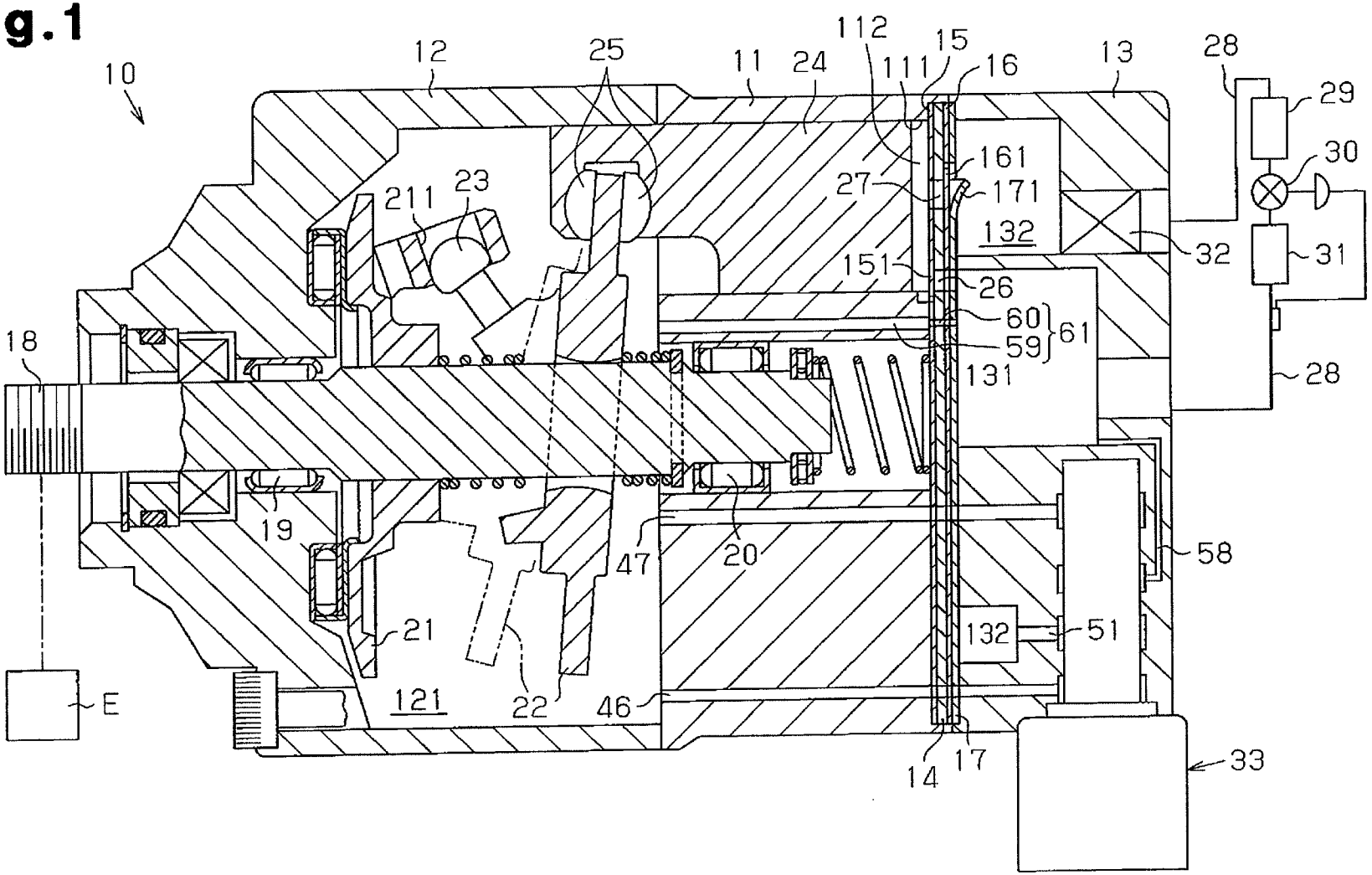
FIG. 1 is a cross-sectional side view showing a compressor, as a whole, which employs a displacement control valve according to a first embodiment of the present invention.

As shown in FIG. 1, a front housing member 12 is joined to the front end of a cylinder block 11. A rear housing member 13 is connected to the rear end of the cylinder block 11 through a valve plate 14, valve forming plates 15, 16, and a retainer forming plate 17. The cylinder block 11, the front housing member 12, and the rear housing member 13 configure the housing assembly of a variable displacement compressor 10.

A rotary shaft 18 is rotationally supported by the front housing member 12 and the cylinder block 11, which form a control pressure chamber 121, through radial bearings 19, 20. The rotary shaft 18 projects outward from the control pressure chamber 121 and receives rotating drive force from a non-illustrated external drive source E (for example, the engine of a vehicle).

A rotary support 21 is attached to the rotary shaft 18. A swash plate 22 is supported by the rotary shaft 18 and faces the rotary support 21. Specifically, the rotary shaft 18 supports the swash plate 22 in a manner slideable and inclinable in the axial direction of the rotary shaft 18.

A guide hole 211 is formed in the rotary support 21 and a guide pin 23, which is formed in the swash plate 22, is slideably received in the guide hole 211. The guide hole 211 and the guide pin 23 cooperate with each other to allow the swash plate 22 to incline in the axial direction of the rotary shaft 18 and rotate integrally with the rotary shaft 18. When inclining, the swash plate 22 is guided through slide-guiding by the guide pin 23 in the guide hole 211 and slide-supporting by the rotary shaft 18.

As a radially middle portion of the swash plate 22 moves toward the rotary support 21, the inclination angle of the swash plate 22 increases. The maximum inclination angle of the swash plate 22 is defined by contact between the rotary support 21 and the swash plate 22. In FIG. 1, the swash plate 22 is in a minimum inclination angle state as indicated by the corresponding solid lines and in a maximum inclination angle state as indicated by the chain lines. The minimum inclination angle of the swash plate 22 is slightly larger than 0°.

A plurality of cylinder bores 111 extend through the cylinder block 11. Each of the cylinder bores 111 receives a corresponding piston 24. Rotation of the swash plate 22 is converted into forward-rearward reciprocation of each of the pistons 24 through a shoe 25. The pistons 24 thus reciprocate in the corresponding cylinder bores 111.

In the rear housing member 13, a suction chamber 131, which is a suction pressure zone, and a discharge chamber 132, which is a discharge pressure zone, are defined. A plurality of suction ports 26 are formed in the valve plate 14, the valve forming plate 16, and the retainer forming plate 17 in correspondence with the cylinder bores 111. A plurality of discharge ports 27 are formed in the valve plate 14 and the valve forming plate 15 in correspondence with the cylinder bores 111. A plurality of suction valves 151 are formed in the valve forming plate 15 in correspondence with the cylinder bores 111. A plurality of discharge valves 161 are formed in the valve forming plate 16 in correspondence with the cylinder bores 111. The cylinder bores 111, the valve forming plate 15, and the pistons 24 define a compression chamber 112 in the cylinder block 11.

As the pistons 24 move from the top dead center to the bottom dead center (move from the right to the left as viewed in FIG. 1), refrigerant flows from the suction chamber 131 into the compression chamber 112 via the suction ports 26 by pressing the suction valves 151. As the piston 24 move from the bottom dead center to the top dead center (move from the left to the right as viewed in FIG. 1), the refrigerant flows out of the compression chamber 112 into the discharge chamber 132 via the discharge ports 27 by pressing the discharge valves 161. The opening degree of each of the discharge valves 161 is restricted by contact between the discharge valves 161 and a retainer 171, which is formed by the retainer forming plate 17.

As the pressure in the control pressure chamber 121 decreases, the inclination angle of the swash plate 22 increases to increase the displacement. When the inclination angle of the swash plate 22 is maximized, the displacement is maximized. In contrast, as the pressure in the control pressure chamber 121 increases, the inclination angle of the swash plate 22 decreases to decrease the displacement. When the inclination angle of the swash plate 22 is minimized, the displacement is minimized.

The suction chamber 131 and the discharge chamber 132 are connected to each other through an external refrigerant circuit 28. The external refrigerant circuit 28 includes a heat exchanger 29 for removing heat from refrigerant, an expansion valve 30, and a heat exchanger 31 for transferring heat from the vicinity of the heat exchanger 31 to the refrigerant. The expansion valve 30 is a thermostatic automatic expansion valve, which adjusts the flow amount of refrigerant in correspondence with variation of the gas temperature at the outlet of the heat exchanger 31. A circulation preventing portion 32 is formed between the discharge chamber 132 and the external refrigerant circuit 28. When the circulation preventing portion 32 is open, refrigerant is allowed to flow from the discharge chamber 132 into the external refrigerant circuit 28 and thus return to the suction chamber 131.

The control pressure chamber 121 and the suction chamber 131 communicate with each other through a passage 59 extending through the cylinder block 11 and a restriction passage 60 extending through the retainer forming plate 17, the valve plate 14, and the valve forming plates 15, 16. The passage 59 and the restriction passage 60 configure a constantly open passage 61, which constantly allows communication between the control pressure chamber 121 and the suction chamber 131.

An electromagnetic type displacement control valve 33 is attached to the rear housing member 13.

Figure 2:
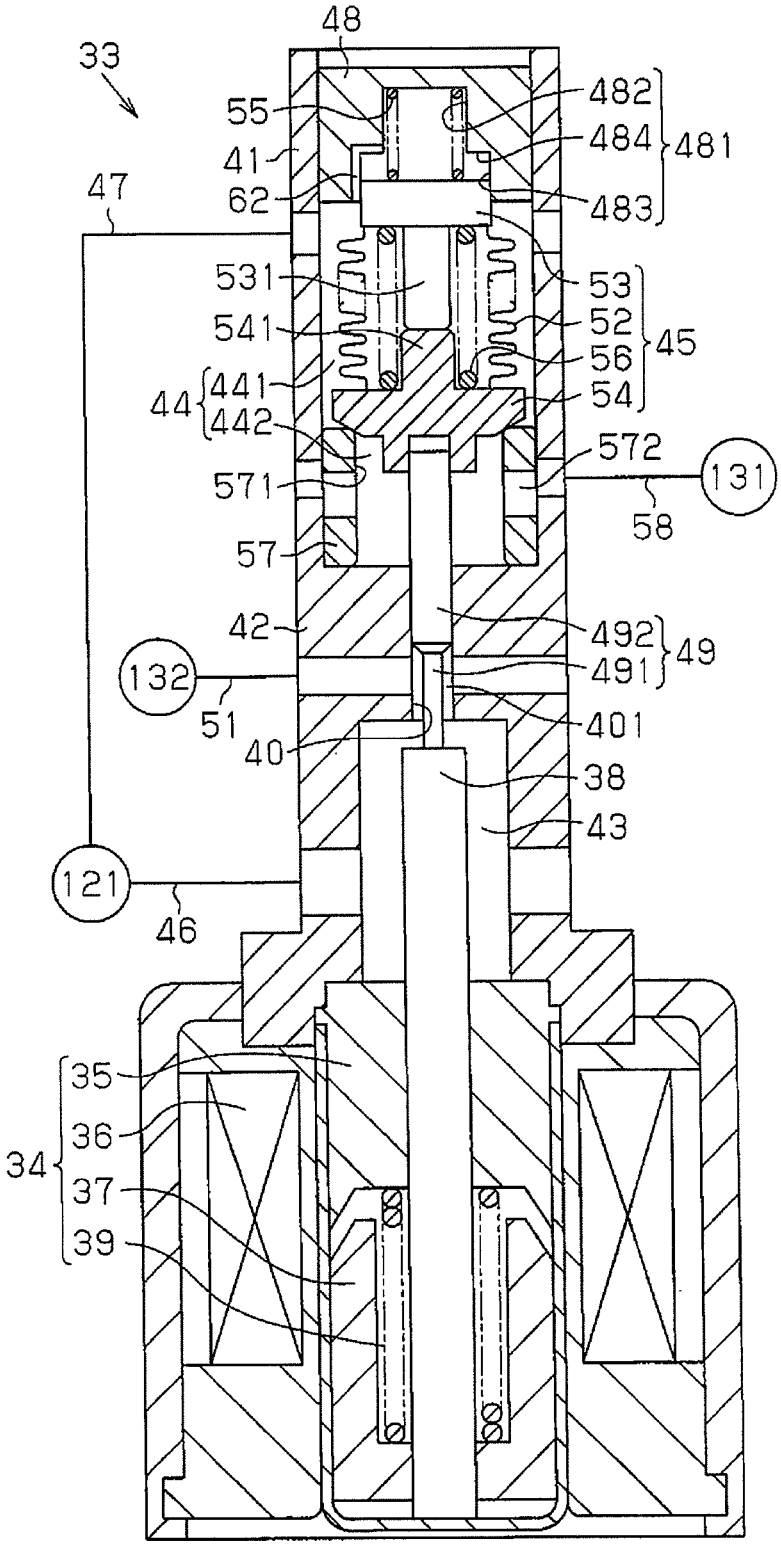
FIG. 2 is a partially enlarged cross-sectional side view showing the displacement control valve in an OFF operation.

As shown in FIG. 2, the displacement control valve 33 includes an electromagnetic solenoid 34, which has a fixed iron core 35, a coil 36, a movable iron core 37, and a spring 39. The fixed iron core 35 of the electromagnetic solenoid 34 attracts the movable iron core 37 when the coil 36 receives an electric current and becomes excited. A second valve body 38 is attached to the movable iron core 37. The electromagnetic solenoid 34 is subjected to electric current supply control (in the first embodiment, duty cycle control) by a non-illustrated control computer.

A partition wall 42 is formed in a valve housing 41, which is a component of the displacement control valve 33. The partition wall 42 divides the interior of the valve housing 41 into a valve chamber 43 and a pressure sensitive chamber 44. A distal portion of the second valve body 38 is arranged in the valve chamber 43 and a pressure sensitive body 45 is received in the pressure sensitive chamber 44. The pressure sensitive chamber 44 communicates with the control pressure chamber 121 through a passage 47. A lid 48 is fixedly received in the valve housing 41 to close the pressure sensitive chamber 44.

A valve hole 40 extends through the partition wall 42. The second valve body 38 selectively contacts and separates from the partition wall 42 to selectively open and close the valve hole 40. The electromagnetic force produced by the electromagnetic solenoid 34 urges the second valve body 38 to a position for closing the valve hole 40 against the urging force of the spring 39.

A pressure sensitive body 45 has a bellows 52, a pressure receiving body 53 joined to one end of the bellows 52, a first valve body 54 connected to the other end of the bellows 52, and a second urging spring 56, which urges the pressure receiving body 53 and the first valve body 54 away from each other in the bellows 52. A stepped recess 481 is formed in an inner end surface of the lid 48. In other words, the pressure sensitive chamber 44 includes the stepped recess 481. The stepped recess 481 has a small diameter portion 482 and a large diameter portion 483. The small diameter portion 482 accommodates a first urging spring 55. The first urging spring 55 urges the pressure receiving body 53 toward the first valve body 54. The pressure receiving body 53 is received in the large diameter portion 483. The large diameter portion 483 is a guide portion for guiding the pressure receiving body 53 (the pressure sensitive body 45) in the movement direction of a drive force transmitting body 49.

In the bellows 52, a stopper 531 is formed integrally with the pressure receiving body 53. A stopper 541 is formed integrally with the first valve body 54 in the bellows 52 such that the stopper 541 is allowed to selectively contact and separate from the stopper 531. The stopper 531 and the stopper 541 define the minimum length of the bellows 52, which selectively extends and contracts.

In the pressure sensitive chamber 44, a tubular valve seat 57 is fitted and fixed to the inner peripheral surface of the valve housing 41. The position of the valve seat 57 is adjustable in the movement direction of the drive force transmitting body 49. The first valve body 54, which selectively contacts and separates from the valve seat 57, divides the interior of the pressure sensitive chamber 44 into a first pressure sensitive chamber 441 and a second pressure sensitive chamber 442. A communication passage 62 for allowing communication between the first pressure sensitive chamber 441 and the small diameter portion 482 of the stepped recess 481 is formed between the inner peripheral surface of the large diameter portion 483 and the outer peripheral surface of the pressure receiving body 53. The small diameter portion 482 communicates with the first pressure sensitive chamber 441. The second pressure sensitive chamber 442 communicates with the suction chamber 131 via a valve hole 571 in the valve seat 57 and a communication port 572 and a passage 58, which communicate with the valve hole 571. The passage 47, the first pressure sensitive chamber 441, the valve hole 571, the second pressure sensitive chamber 442, the communication port 572, and the passage 58 configure an outlet passage extending from the control pressure chamber 121 to the suction chamber 131. The first valve body 54 adjusts the cross-sectional area of the outlet passage.

The bellows 52 selectively extends and contracts in the movement direction of the drive force transmitting body 49 in correspondence with the pressure in the pressure sensitive chamber 44. The pressure sensitive body 45 and the pressure sensitive chamber 44 configure a pressure sensitive portion. The surface of the pressure receiving body 53 facing the small diameter portion 482 receives the pressure in the first pressure sensitive chamber 441, thus urging the pressure sensitive body 45 in the direction in which the first valve body 54 closes the valve hole 571, which is a portion of the outlet passage.

The drive force transmitting body 49 includes a small diameter portion 491 and a large diameter portion 492. The large diameter portion 492 extends through the valve hole 40 and projects into the second pressure sensitive chamber 442.

A distal portion of the large diameter portion 492 selectively contacts and separates from the first valve body 54. The large diameter portion 492 separates the second pressure sensitive chamber 442 from the valve chamber 43. An annular clearance 401 is formed around the small diameter portion 491. The clearance 401 communicates with the discharge chamber 132 through a passage 51. The valve chamber 43 is allowed to communicate with the discharge chamber 132 through the valve hole 40. The passage 51, the valve hole 40, the valve chamber 43, and the passage 46 configure a supply passage extending from the discharge chamber 132 to the control pressure chamber 121. The second valve body 38 adjusts the cross-sectional area of the supply passage.

The opening extent of the displacement control valve 33 in the valve hole 40, which is the opening degree of the second valve body 38 in the displacement control valve 33, is determined depending on equilibrium among the electromagnetic force produced by the electromagnetic solenoid 34, the urging force of the spring 39, and the urging force of the pressure sensitive portion. The displacement control valve 33 is capable of continuously adjusting the opening degree of the second valve body 38 in the displacement control valve 33 by varying the electromagnetic force. As the electromagnetic force of the electromagnetic solenoid 34 increases, the opening degree of the second valve body 38 in the displacement control valve 33 decreases.

Operation of the first embodiment will hereafter be described.

FIG. 2 shows a state in which supply of an electric current to the electromagnetic solenoid 34 of the displacement control valve 33 is suspended. In this state, the duty cycle of the electric current fed to the electromagnetic solenoid 34 is zero. Hereinafter, the state will be referred to as an OFF operation of the displacement control valve 33. Also, in this state, the opening degree of the second valve body 38 in the displacement control valve 33 is maximized. The minimum inclination angle of the swash plate 22 is set to an angle slightly larger than 0°. Accordingly, even when the swash plate 22 is inclined at the minimum inclination angle, the flow of the refrigerant from the cylinder bores 111 into the discharge chamber 132 is maintained. When the inclination angle of the swash plate 22 is minimized, the circulation preventing portion 32 is closed to block refrigerant circulation in the external refrigerant circuit 28. This state is referred to as a minimum displacement operation. Some of the refrigerant that has been sent from the cylinder bores 111 into the discharge chamber 132 flows into the control pressure chamber 121 via the valve hole 40 and the valve chamber 43 of the displacement control valve 33 and the passage 46.

Figure 4B:
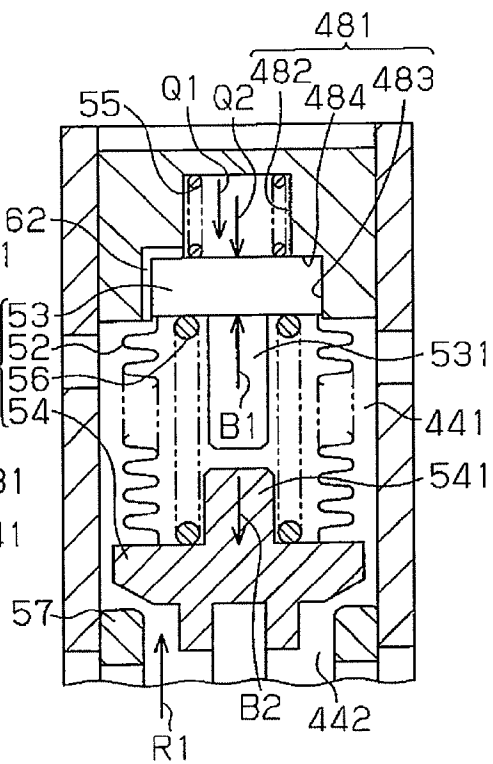
FIG. 4B is an explanatory diagram illustrating equilibrium of the forces acting on the bellows in the displacement control valve in the OFF operation.
Figure 4A:
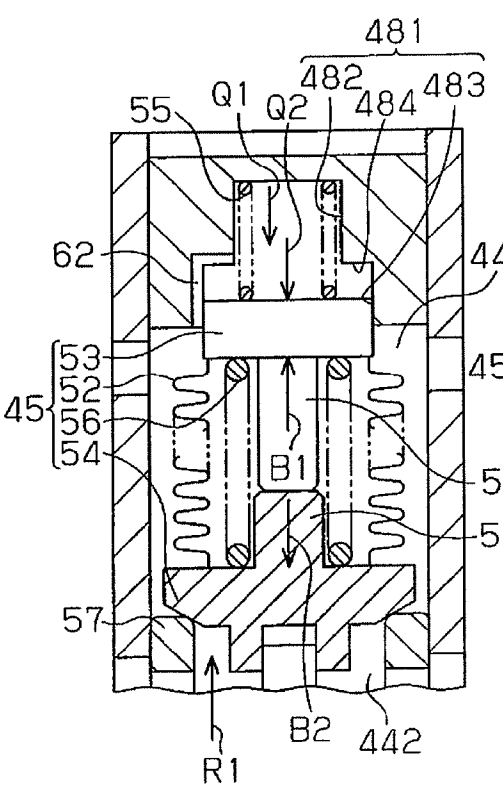
FIG. 4A is an explanatory diagram illustrating equilibrium of the forces acting on a bellows in the displacement control valve in the OFF operation.

With reference to FIGS. 4A and 4B, equilibrium of the forces acting on the bellows 52 when the electric current supply to the electromagnetic solenoid 34 is suspended (in the OFF operation) will hereafter be described.

In FIG. 4A, arrow Q1 represents the direction of the force represented by the product Pc×S of the control pressure Pc in the first pressure sensitive chamber 441 and the effective pressure receiving area S of the bellows 52 (the effective pressure receiving area of the bellows 52 in the direction in which the bellows 52 extends). The effective pressure receiving area S is equal to the cross-sectional area of the valve hole 571. The force Pc×S urges the pressure receiving body 53 in the direction in which the first valve body 54 closes. Arrow Q2 represents the direction of the force Fsp produced by the first urging spring 55. The force Fsp urges the pressure receiving body 53 in the direction in which the first valve body 54 closes. Arrow R1 represents the direction of the force represented by the product Ps×S of the suction pressure Ps in the second pressure sensitive chamber 442 and the effective pressure receiving area S of the bellows 52. The force Ps×S urges the first valve body 54 toward the pressure receiving body 53. Arrow B1 represents the direction of the force Fb generated by the second urging spring 56. Arrow B2 also represents the direction of the force Fb of the second urging spring 56. The force Fb acting in the direction represented by arrow B1 urges the pressure receiving body 53 away from the first valve body 54. The force Fb acting in the direction represented by arrow B2 urges the first valve body 54 away from the pressure receiving body 53.

The force Fb of the second urging spring 56 is set to the value represented by Fsp+Pc2×S. The value Pc2 is the upper limit of the control pressure Pc (Pc2≥Pc) at the time when the electromagnetic solenoid 34 receives an electric current (as will hereinafter be referred to as an ON operation). The bellows 52 receives the force represented by Fsp+Pc×S in the direction in which the bellows 52 contracts.

In the state of FIG. 4A, the control pressure Pc exceeds the upper limit Pc2. In this state, the force acting in the direction in which the bellows 52 contracts, which is Fsp+Pc×S, exceeds the force Fb (Fb=Fsp+Pc2×S) of the second urging spring 56 in the direction in which the bellows 52 extends. This contracts the bellows 52 to allow contact between the stoppers 531, 541 and presses the first valve body 54 against the valve seat 57 by the force Fsp+(Pc−Ps)×S (Pc>Ps). As a result, the valve hole 571 is closed and the refrigerant in the control pressure chamber 121 flows into the suction chamber 131 only through the constantly open passage 61. This allows the swash plate 22 to rotate at the minimum inclination angle, thus causing the variable displacement compressor 10 to perform the minimum displacement operation in which the displacement is minimized. In this case, the circulation preventing portion 32 is closed to prevent flow of the refrigerant in the external refrigerant circuit 28.

In the state of FIG. 4B, the control pressure Pc is lower than the upper limit Pc2. In this state, the force acting in the direction in which the bellows 52 contracts, which is Fsp+Pc×S, is smaller than the force Fb (Fb=Fsp+Pc2×S) of the second urging spring 56 in the direction in which the bellows 52 extends. This contracts the bellows 52 to such an extent that the stoppers 531, 541 are prevented from contacting each other. However, the first valve body 54 is pressed against the valve seat 57 by the force Fb−Ps×S. As a result, the valve hole 571 is closed and the refrigerant in the control pressure chamber 121 flows into the suction chamber 131 only through the constantly open passage 61. This allows the swash plate 22 to rotate at the minimum inclination angle, thus causing the variable displacement compressor 10 to perform the minimum displacement operation in which the displacement is minimized. In this case, the circulation preventing portion 32 is closed to prevent circulation of the refrigerant in the external refrigerant circuit 28.

Figure 3:
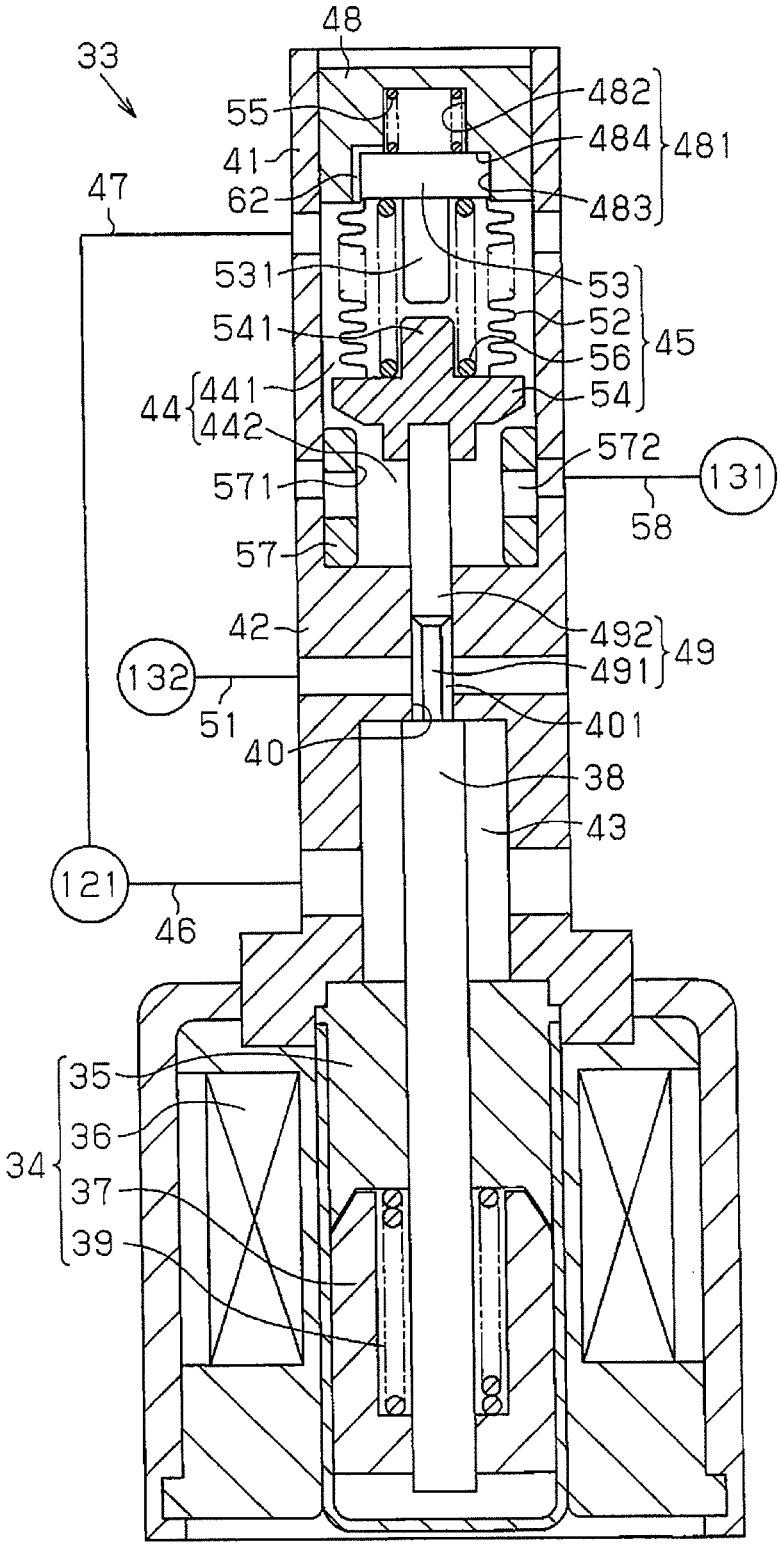
FIG. 3 is a partially enlarged cross-sectional side view showing the displacement control valve in an ON operation.

FIG. 3 shows a state in which the electric current supply to the electromagnetic solenoid 34 of the displacement control valve 33 is carried out. In this state, the duty cycle of the electric current supplied to the electromagnetic solenoid 34 is greater than 0 and the state will hereafter be referred to as an ON operation. Also, in this state, some of the refrigerant in the control pressure chamber 121 is sent into the suction chamber 131 through the passage 47, the pressure sensitive chamber 44, and the passage 58.

Figure 5:
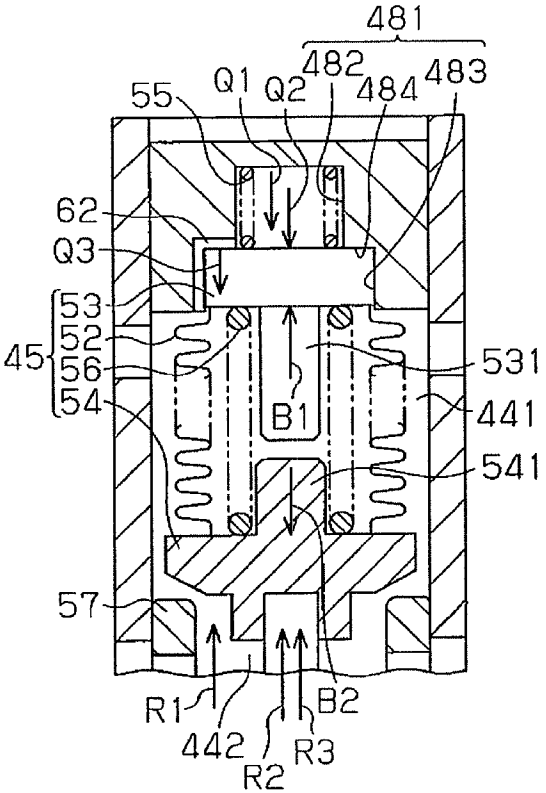
FIG. 5 is an explanatory diagram illustrating equilibrium of the forces acting on the bellows in the displacement control valve in the ON operation.

With reference to FIG. 5, equilibrium of the forces acting on the bellows 52 in the ON operation will now be described.

Arrow Q3 represents the direction of the reactive force Fn applied by a step 484 of the stepped recess 481 to the pressure receiving body 53 at the time when the pressure receiving body 53 contacts the step 484. The reactive force Fn is represented by Fb−Fsp−Pc×S. Arrow R2 represents the direction of the force represented by the product (Pc−Ps)×Srod of the difference (Pc−Ps) between the control pressure Pc and the suction pressure Ps and the cross-sectional area Srod of the large diameter portion 492 of the drive force transmitting body 49. The interior of the valve chamber 43 is in the atmosphere of the control pressure. The force Pc×Srod urges the second valve body 38 in the direction represented by arrow R2. The interior of the second pressure sensitive chamber 442 is in the atmosphere of the suction pressure Ps. The force Ps×Srod urges the second valve body 38 in the direction opposite to the direction of arrow R2. Arrow R3 represents the direction of the electromagnetic force Fso produced through the electric current supply to the electromagnetic solenoid 34.

In the state of FIG. 5, the control pressure Pc is lower than the upper limit Pc2. In this state, the bellows 52 is contracted without allowing contact between the stoppers 531, 541. The pressure receiving body 53 is pressed against the step 484 by the force Fn. The first valve body 54 opens the valve hole 571 through the equilibrium represented by Fso+(Pc−Ps)×Srod+Ps×S−Fb=0, thus stabilizing the opening degree of the first valve body 54. As a result, the refrigerant in the control pressure chamber 121 flows into the suction chamber 131 through the constantly open passage 61 and via the outlet passage configured by the passage 47, the first pressure sensitive chamber 441, the valve hole 571, the second pressure sensitive chamber 442, the communication port 572, and the passage 58. In this state, the inclination angle of the swash plate 22 exceeds the minimum inclination angle and the variable displacement compressor 10 performs middle displacement operation, in which the inclination angle of the swash plate 22 is greater than the minimum inclination angle. In this case, the circulation preventing portion 32 is open to allow the refrigerant to circulate in the external refrigerant circuit 28.

Figure 6:
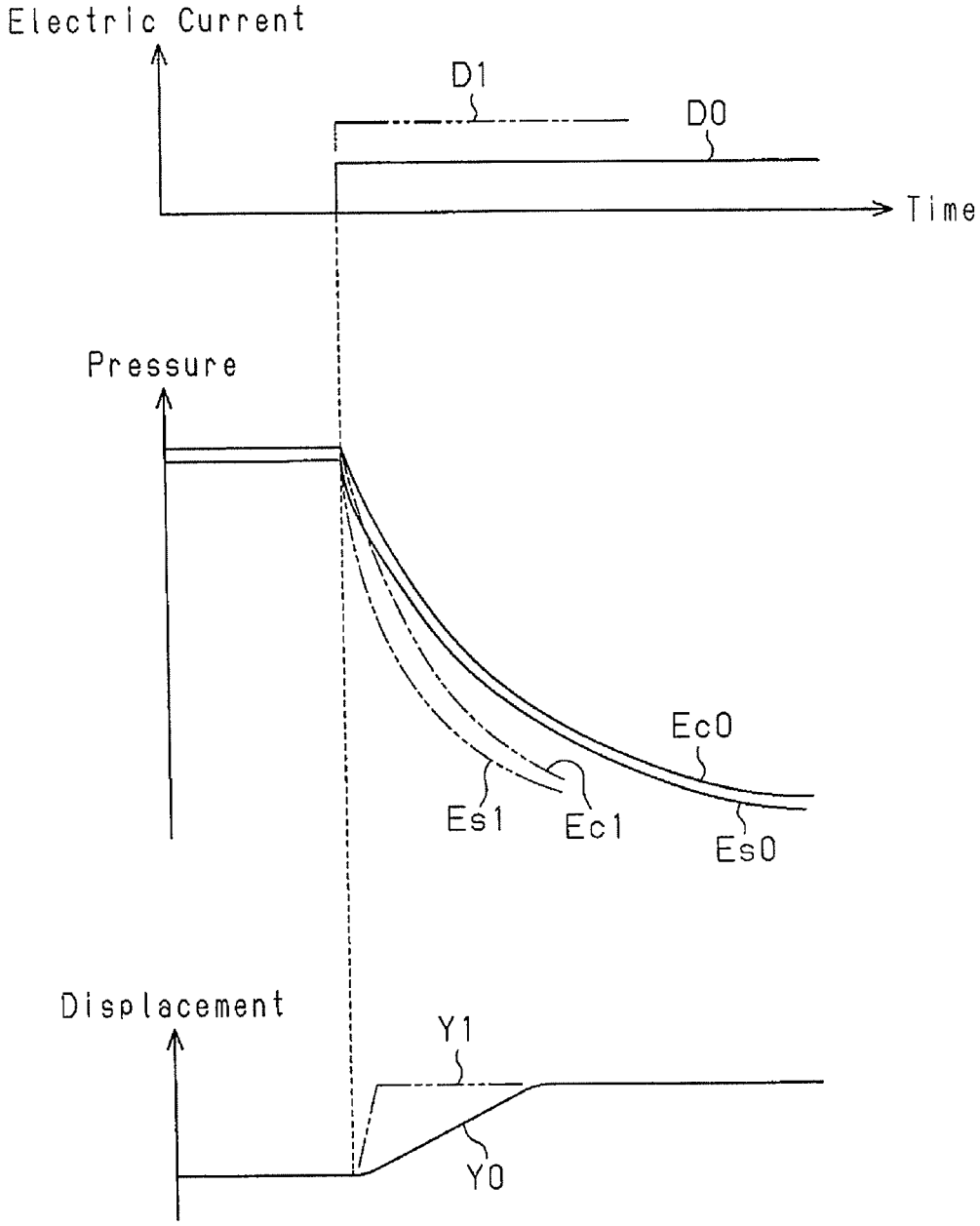
FIG. 6 is a graph representing variation of control pressure, variation of suction pressure, and variation of displacement.

In the graph of FIG. 6, the waveform D0 represents variation of the amount of an electric current supplied to the electromagnetic solenoid 34 (variation of the electromagnetic force). The curve Ec0 represents an example of variation of the control pressure Pc corresponding to the variation represented by the waveform D0. The curve Es0 represents an example of variation of the suction pressure Ps corresponding to the variation of the waveform D0. The curve Y0 represents an example of variation of the displacement corresponding to the variation of the waveform D0. The duty cycle of the amount of the electric current supply represented by the waveform D0 is smaller than 100%.

The force represented by the product of the upper limit (Pc−Ps) max of a predetermined pressure difference (Pc−Ps) and the effective pressure receiving area S is defined as the electromagnetic force Fso of the electromagnetic solenoid 34 at the time when the electromagnetic solenoid 34 is actuated. If the pressure difference (Pc−Ps) exceeds the upper limit (Pc−Ps)max, the second valve body 38 opens the valve hole 40 to a greater extent to prevent a rapid increase in the displacement. For example, in response to the start of the electric current supply to the electromagnetic solenoid 34, the opening degree of the valve hole 40 decreases to lower the control pressure Pc, thus increasing the displacement. At this stage, the suction pressure Ps drops by a larger amount than the control pressure Pc. This increases the pressure difference (Pc−Ps) between the control pressure Pc and the suction pressure Ps, thus increasing the opening degree of the valve hole 40. As a result, a larger amount of refrigerant is sent from the discharge chamber 132 into the control pressure chamber 121. This raises the control pressure in the control pressure chamber 121 and further increases the pressure difference (Pc−Ps). When the pressure difference (Pc−Ps) exceeds the upper limit (Pc−Ps)max, the opening degree of the valve hole 40 increases to a greater value. The control pressure in the control pressure chamber 121 thus rises to a greater level, thus preventing a rapid increase in the inclination angle of the swash plate 22. The displacement is thus prevented from rapidly increasing. As the displacement increases, the suction pressure Ps increases and the pressure difference (Pc−Ps) decreases. This decreases the opening degree of the valve hole 40 and increases the displacement.

The curve D1 represents the electric current supply in the case where the duty cycle is 100%. The curve Ec1, the curve Es1, and the curve Y1 represent variation of the control pressure, variation of the suction pressure, and variation of the displacement, respectively, in the same case as the case for the curve D1.

As is clear from comparison between the curves Ec0, Es0 and the curves Ec1, Es1, the control pressure and the suction pressure in the initial stage of the ON operation in the case of the electric current supply represented by the waveform D0 vary moderately compared to the control pressure and the suction pressure in the case of the electric current supply represented by the curve D1. Also, the displacement represented by the curve Y0 in the initial stage of the ON operation in the case of the electric current supply represented by the waveform D0 varies moderately compared to the displacement represented by the curve Y1 in the case of the electric current supply represented by the curve D1.

The first embodiment has the advantages described below.

(1) When the electromagnetic solenoid 34 is de-excited, the opening degree of the second valve body 38 is maximized and the pressure (the control pressure) in the control pressure chamber 121 is high. The pressure in the control pressure chamber 121 is received by the surface of the pressure receiving body 53 facing the small diameter portion 482. This urges the pressure sensitive body 45 in the direction in which the first valve body 54 closes the valve hole 571, which is a portion of the outlet passage. Accordingly, even when the pressure in the control pressure chamber 121 increases, the first valve body 54 is maintained in a closed state. As a result, the minimum displacement operation of the variable displacement compressor 10 is reliably maintained.

(2) If the suction pressure exceeds the control range, the first valve body 54 is arranged at the position for closing the valve hole 571 with the bellows 52 held in a maximally contracted state by the control pressure, which is higher than the suction pressure. When the electromagnetic solenoid 34 is excited (the ON operation is started) in this state (in the OFF operation), the opening degree of the second valve body 38 decreases and the suction pressure drops rapidly compared to the control pressure. The difference between the suction pressure and the control pressure at this stage is easily controlled by controlling the excitation state of the electromagnetic solenoid 34. This facilitates control on the load acting on the variable displacement compressor 10 at the time when the compressor 10 is actuated (the OFF operation is switched to the ON operation) and control for suppressing a rapid increase in the displacement at the time of actuation of the compressor 10.

(3) The cross-sectional area of the valve hole 571, which is selectively opened and closed by the first valve body 54, is equal to the effective pressure receiving area of the bellow 52. This ensures the displacement control through equilibrium between the pressure difference between the control pressure and the suction pressure and the electromagnetic drive force of the electromagnetic solenoid 34.

(4) The pressure receiving body 53 is received in and guided by the large diameter portion 483 of the recess 481. As a result, the pressure sensitive body 45 is prevented from inclining and allowed to move smoothly in the movement direction of the drive force transmitting body 49.

(5) The first urging spring 55 urges the pressure sensitive body 45 toward the valve seat 57. The first valve body 54 is urged toward the position for closing the valve hole 571 by the urging force of the first urging spring 55. Accordingly, when the electromagnetic solenoid 34 is de-excited (in the OFF operation), the first valve body 54 is maintained reliably at the closing position by the first urging spring 55. As a result, the refrigerant in the control pressure chamber 121 is prevented from flowing into the suction chamber 131 via the valve hole 571, thus maintaining the swash plate 22 reliably at the minimum inclination angle.

(6) Since the fitting position of the valve seat 57 is changeable, the maximum extension-contraction amount of the bellows 52 is adjustable. This ensures fine adjustment of spring characteristics of the pressure sensitive body 45.

The present invention may be embodied in the forms described below.

The amount of the electric current supplied to the electromagnetic solenoid 34 may be set to a value (with the duty cycle of 100%) sufficient for attracting the movable iron core 37 in a short time (instantly) in the initial stage after the start of the electric current supply. The amount of the electric current supplied to the electromagnetic solenoid 34 is then decreased to a small value as in the first embodiment. This case also ensures the advantages of the first embodiment.

The communication passage 62 may be configured by the clearance between the inner peripheral surface of the large diameter portion 483 and the outer peripheral surface of the pressure receiving body 53.

The displacement control valve according to the present invention may be used in a variable displacement compressor having an electromagnetic clutch.

Therefore, the present examples and embodiments are to be considered as illustrative and not restrictive and the invention is not to be limited to the details given herein, but may be modified within the scope and equivalence of the appended claims.

The invention claimed is:

1. A displacement control valve configured to be used in a variable displacement compressor, wherein refrigerant is supplied from a discharge pressure zone to a control pressure chamber through a supply passage and sent out from the control pressure chamber into a suction pressure zone through an outlet passage to adjust the pressure in the control pressure chamber so that displacement is controlled, the displacement control valve comprising:

an electromagnetic solenoid;

a drive force transmitting body actuated by the electromagnetic solenoid;

a pressure sensitive portion having a pressure sensitive chamber configured to communicate with the control pressure chamber and a pressure sensitive body that selectively extends and contracts in a movement direction of the drive force transmitting body in correspondence with pressure in the pressure sensitive chamber;

a first valve body that is arranged in the pressure sensitive body to adjust the cross-sectional area of the outlet passage; and a second valve body that is connected to the drive force transmitting body to adjust the cross-sectional area of the supply passage, wherein the pressure sensitive body is movable in the movement direction of the drive force transmitting body in the pressure sensitive chamber, the pressure sensitive body includes a bellows, a pressure receiving body connected to one end of the bellows, and the first valve body connected to a second end of the bellows, and the pressure receiving body urges the bellows by receiving the pressure in the control pressure chamber and moves the one end of the bellow in a direction in which the first valve body closes.

2. The displacement control valve according to claim 1, wherein a portion of the outlet passage forms a valve hole that is selectively opened and closed by the first valve body, and the cross-sectional area of the valve hole is set to a value equal to an effective pressure receiving area of the pressure sensitive body.

3. The displacement control valve according to claim 1, further comprising a guide portion for guiding movement of the pressure sensitive body in the movement direction of the drive force transmitting body.

4. The displacement control valve according to claim 1, further comprising an urging spring that urges the pressure sensitive body in the direction in which the first valve body closes.

5. The displacement control valve according to claim 4, wherein the pressure sensitive chamber has a recess having a small diameter portion and a large diameter portion, and the urging spring is a first urging spring accommodated in the small diameter portion.

6. The displacement control valve according to claim 5, wherein the pressure receiving body is arranged in the large diameter portion, and the pressure sensitive body includes a second urging spring that urges the pressure receiving body and the first valve body away from each other in the bellows.

7. The displacement control valve according to claim 1, wherein a portion of the outlet passage forms a valve hole that is selectively opened and closed by the first valve body, the displacement control valve further comprising:

a valve seat, the first valve body selectively contacting and separating from the valve seat; and a valve housing that accommodates the first valve body, the valve hole is formed in the valve seat to face the first valve body, and the valve seat is fitted to the valve housing such that the position of the valve seat is adjustable in the movement direction of the drive force transmitting body.

8. The displacement control valve according to claim 1, wherein the first valve body divides the pressure sensitive chamber into a first pressure sensitive chamber and a second pressure sensitive chamber, the first pressure sensitive chamber is configured to communicate with the control pressure chamber, the second pressure sensitive chamber is configured to communicate with the suction pressure zone in the compressor, and the pressure sensitive body is received in the first pressure sensitive chamber.

* * * * *

UNITED STATES PATENT AND TRADEMARK OFFICE

CERTIFICATE OF CORRECTION

PATENT NO. : 9,181,937 B2
APPLICATION NO. : 13/672757
DATED : November 10, 2015
INVENTOR(S) : Ota et al.

It is certified that error appears in the above-identified patent and that said Letters Patent is hereby corrected as shown below:

In the claims

Column 11, line 31 claim 1, change “the bellow” to -- the bellows --

Signed and Sealed this
Nineteenth Day of April, 2016

Michelle K. Lee

Michelle K. Lee
*Director of the United States Patent and Trademark Office*